US005337713A

United States Patent [19]

Mills

[11] Patent Number: 5,337,713

[45] Date of Patent: Aug. 16, 1994

[54] FEEDBACK CONTROLLED ENGINE STARTING SYSTEM

[75] Inventor: Floyd D. Mills, Valois, N.Y.

[73] Assignee: Ingersoll-Rand Company, Woodcliff Lake, N.J.

[21] Appl. No.: 20,935

[22] Filed: Feb. 22, 1993

[51] Int. Cl.[5] ..... F02N 7/00

[52] U.S. Cl. ..... 123/179.3; 123/179.31

[58] Field of Search ..... 123/179.3, 179.4, 179.2, 123/179.31; 60/627, 39.142

[56] References Cited

U.S. PATENT DOCUMENTS

| | | | |
|---|---|---|---|
| 2,873,577 | 2/1959 | Kenney et al. | 60/39.142 |
| 4,487,173 | 12/1984 | Maucher et al. | 123/179 |
| 4,490,620 | 12/1984 | Hansen | 290/38 |
| 4,494,499 | 1/1985 | Stein | 123/179.31 |
| 4,577,599 | 3/1986 | Chmielewski | 123/179.2 |
| 4,747,270 | 5/1988 | Klie et al. | 60/627 |
| 4,858,585 | 8/1989 | Remmers | 123/602 |
| 4,873,950 | 10/1989 | Furuyama | 123/179 |
| 4,901,689 | 2/1990 | Cummins et al. | 123/179 |
| 4,917,061 | 4/1990 | Nagakura | 123/179 |

*Primary Examiner*—Andrew M. Dolinar
*Attorney, Agent, or Firm*—Walter C. Vliet

[57] ABSTRACT

The engine starting system herein described controls an engine starting sequence which prevents start attempts when the engine is running and regulates the starting function within a control range of revolutions for efficient use of the available starting power either in the form of pressurized fluid from a tank or electrical discharge of a battery to effectively extend the efficient starting cycle of an engine.

3 Claims, 3 Drawing Sheets

FEEDBACK CONTROLLED ENGINE STARTING SYSTEM

BACKGROUND OF THE INVENTION

This invention relates generally to engine starting systems and more particularly to starting systems for air starters for use on vehicles and the like. In prior art air starting systems, the pressure fluid is applied to the starter and the starter operated at self governed speeds, limited by the available air pressure and starter mechanical design. In many cases, this resulted in inefficient utilization of the available air pressure and occasionally cranking speeds in excess of manufacturer's recommendations.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a starter control system for an engine starter comprising means for sensing engine RPM; means for determining engine off condition RPM; means for determining a minimum cranking RPM; means for determining a maximum cranking RPM; means for determining an engine running RPM; and control means for establishing a desired engine cranking and starting sequence in response to the condition sensed sequenced response of the above listed means.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
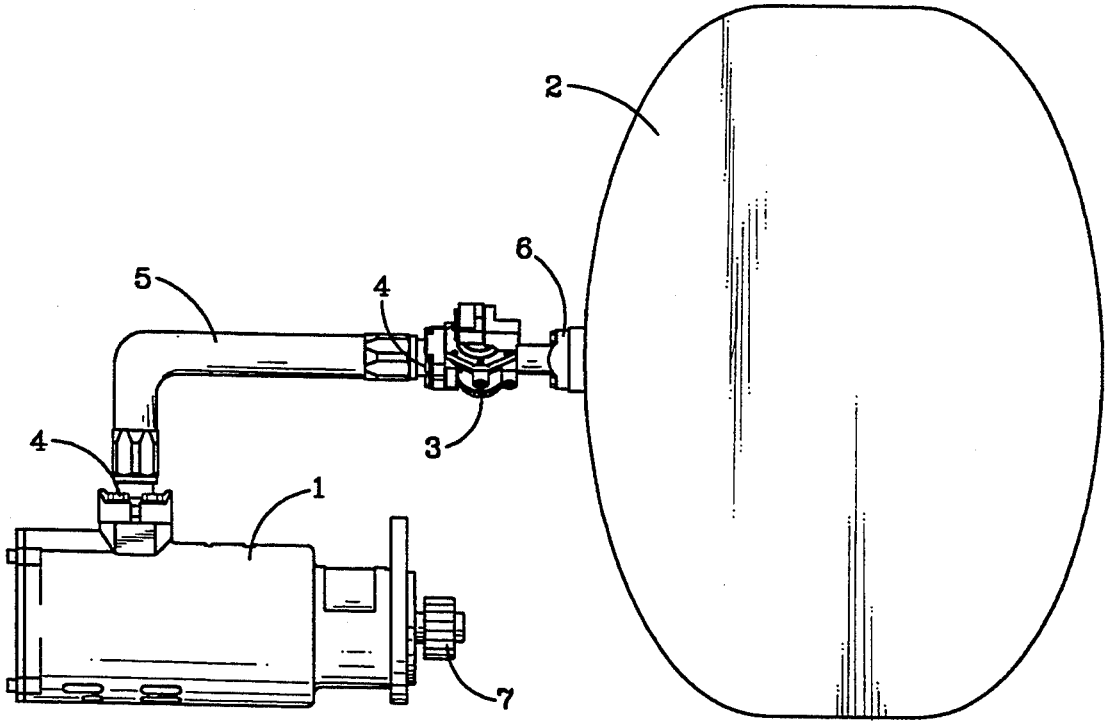
FIG. 1 is a schematic view illustrating an embodiment of the present invention as applied to a vehicle starter.

Referring to FIG. 1, a pneumatic pressure fluid or air starting system for a vehicle is shown comprising a starter driven by the pneumatic pressure fluid having its output on a pinion gear 7, is connected to a pressure fluid source or tank 2 by means of a hose or pipe 5 communicating through a valve assembly 3. Hose flange connections 4 and tank flange connection 6 are shown for convenience of assembly. It should be understood that other hose or pipe connections might be utilized.

In a typical starter system of the prior art, a pushbutton or the like would be utilized by the operator to activate the valve to permit pressure fluid to reach the starter 1. In a typical prior art system, therefore, the output of the starter was controlled by the operator directly and the operating speed of the starter was dependent in part by the operator's judgement and the available pressure of the pressure fluid in the tank. The system design permitted an unskilled operator to substantially waste available pressure fluid in inefficient starting attempts.

According to the present invention, the starting system permits selection of a start cycle which is substantially controlled within engine manufacturer's recommended specifications permitting far better utilization of the available pressure fluid and thereby substantially extending the number or duration of the start cycles.

Figure 5:
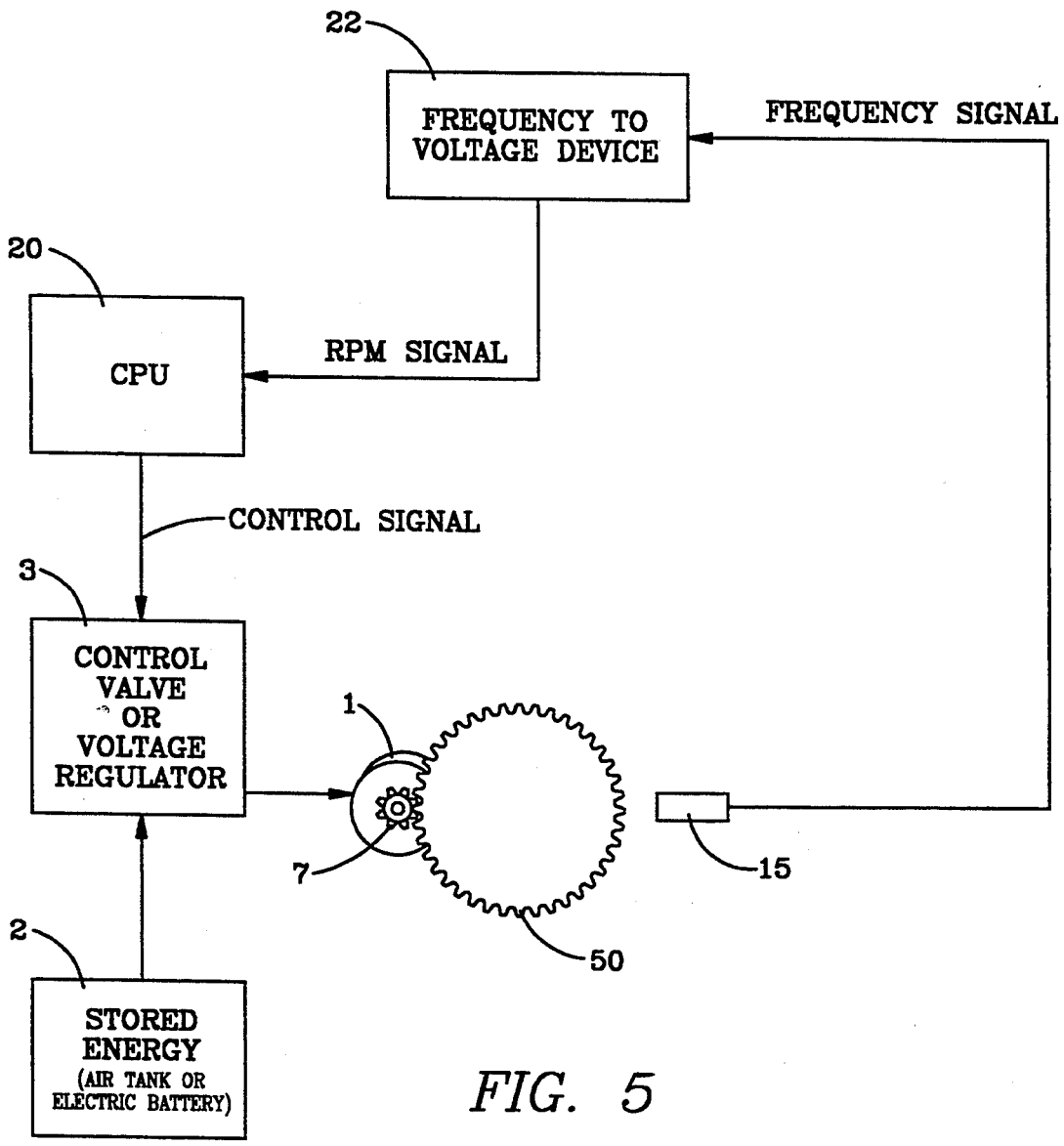
FIG. 5 is a schematic control diagram for the engine starting system.

According to the present invention, the major components of the present starting system are shown in FIG. 5 and includes a starter motor 1 having its output on a pinion 7 which in turn drives the engine flywheel 50. A proximity pickup sensor 15 detects the rotation of the engine flywheel and sends a frequency signal to a frequency voltage device contained within the central processing unit 20. The frequency signal representing engine RPM is sent to the central processing unit 20 and a control signal is developed, as will later be described, to be sent to a control valve 3, or in the case of an electric starter, a voltage regulator device. The control valve selectively transmits the motive power to the starter motor from the stored energy device (tank 2 or electric battery).

Figure 2:
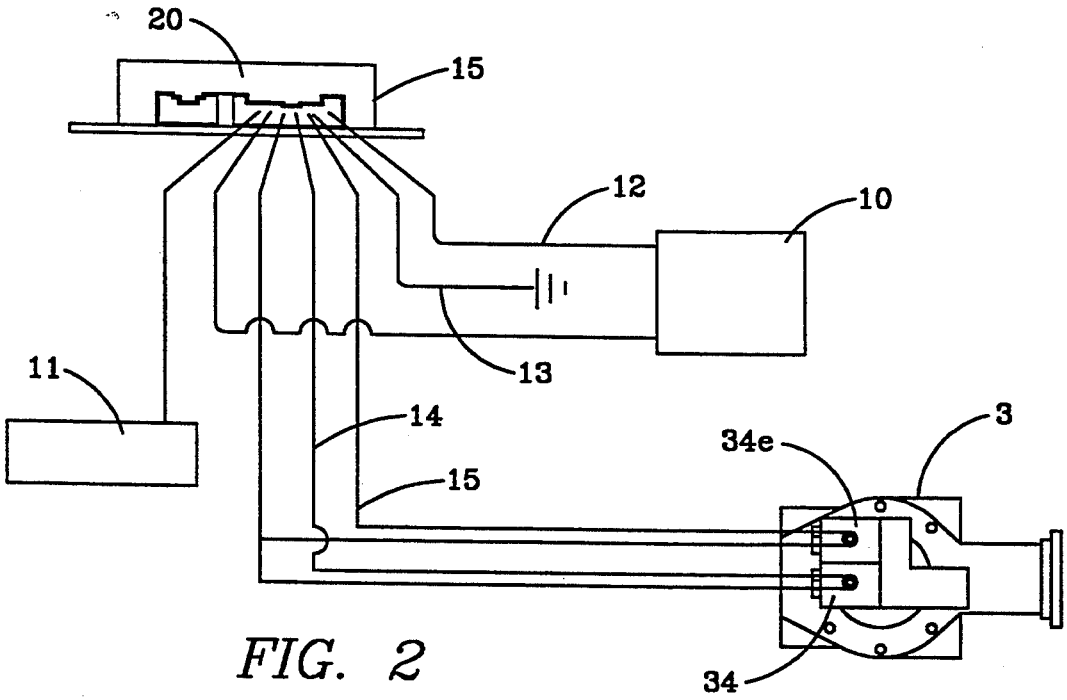
FIG. 2 is a partial schematic showing the control circuit for the engine starter according to the present invention.

FIG. 2 shows the interconnected control signals. A 12 volt power source 12 is applied to the control unit 20 by means of a pushbutton 10. A ground 13 is provided also for this purpose. The proximitor sensor 15 sends a pulse signal to a frequency to voltage device 22 which converts the signal to an engine rotation signal (RPM) which in turn is sent to the control unit 20 in response to engine rotation. The control unit provides a pressure signal 14 and an exhaust signal 15 to the valve assembly 3 in accordance with the sequence which will later be described.

Figure 3:
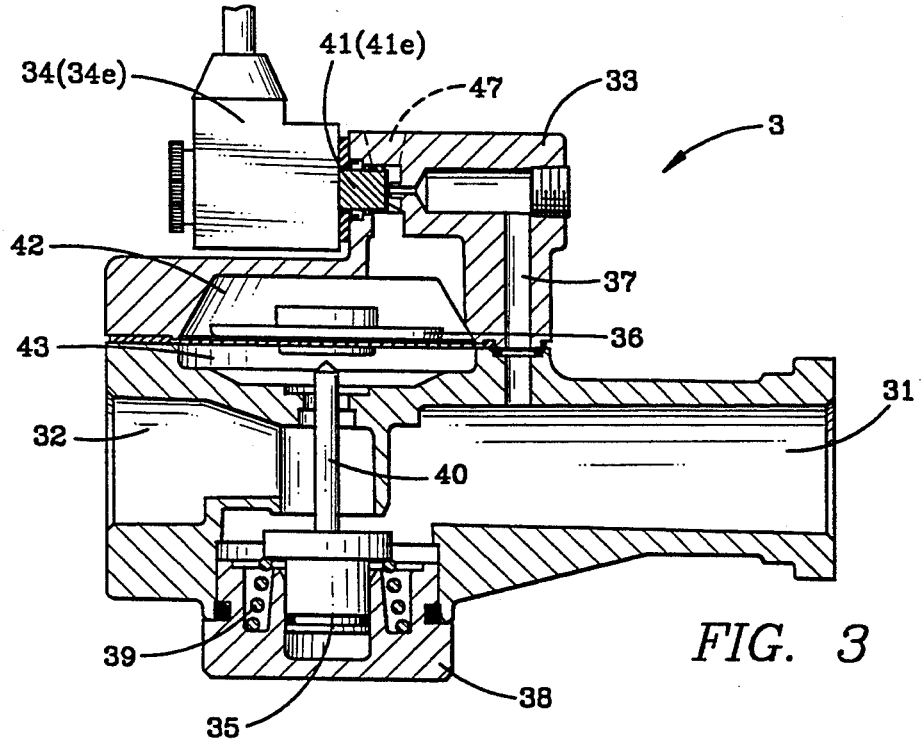
FIG. 3 is a cross sectional view of a starter control valve according to the present invention.

FIG. 3 shows a control valve 3 according to the present invention. The control valve includes an inlet 31 for receiving pressure fluid from the tank 2, and an outlet 32 for providing pressure fluid to the starter contained within the valve body 33. A valve element 35 is disposed between the pressure fluid inlet and outlet in an end cap 38 provided for the purpose of holding and guiding the valve element. A valve spring 39 is provided to bias the valve element 35 to a closed position. A valve stem 40 coacts with a control diaphragm 36 to position the valve element for pressure fluid flow control. The diaphragm 36 divides a chamber within the valve body 33 into an upper cavity 42 and a lower cavity 43.

The lower cavity communicates with the outlet fluid pressure. The upper cavity receives control pressure from the pressure fluid inlet via a control pressure conduit 37 and a solenoid operated valve comprising a solenoid 34 having a pilot plunger valve 41 communicating with the control pressure conduit 37. A corresponding solenoid operated control valve **34*e* (See FIG. 2) having a plunger valve 41*e* (not shown) selectively communicates an exhaust passage 47 (shown dotted in FIG. 3) from the upper cavity to atmosphere. The valve functions in accordance with commands issued by the control unit 20 to the solenoids 34 and 34***e* as follows.

In operation. Once the start pushbutton 10 is depressed, the electronic control unit compares the signals which it receives to several references. The references are (a) engine off, comprising an RPM signal of, for example, less than 25 RPM; (b) a minimum desired cranking RPM; (c) a maximum desired cranking RPM; and (d) an engine running RPM (for example, greater than 300 RPM).

The electronic control unit 20 acts on the RPM signal relative to each of the above four references. First, on depression of the pushbutton, which applies the 12 volt power source, the control unit compares the signal to engine off (a reference). If the engine is not turning, the box will activate the coils of the pressure 34 (normally closed) and the exhaust 34*e* (normally open) solenoid valves. This in turn pressurizes the upper cavity 42 of the regulator valve allowing air to flow to the starter.

Second, when the signal RPM exceed the minimum cranking speed, the control unit de-energizes the pressure solenoid 34, trapping the air pressure in the upper cavity 42 of the regulator. In this mode, the control is inactive as the regulator supplies a fixed pressure to the starter.

Third, when the signal RPM exceeds the maximum cranking RPM, the control unit de-energizes the exhaust solenoid 34*e*, allowing the upper cavity 42 of the regulator to vent and the regulator to move towards the closed position.

Fourth, when the engine starts, it accelerates to its governed idle speed (typically above 300 RPM), the signal initiates the engine running reference. At this point, the control unit locks out to prevent accidental start attempts while the engine is running. This system will only reset after the RPM signal returns to below the engine off reference.

Figure 4:
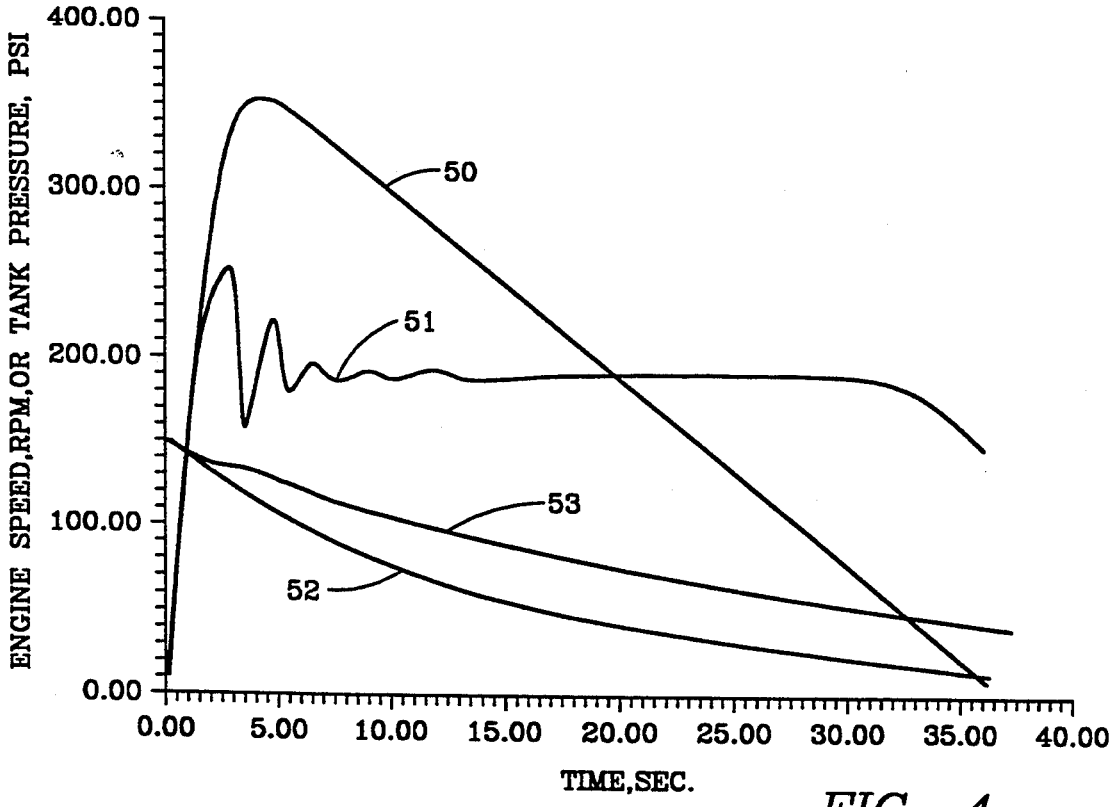
FIG. 4 is a graph representing starter operation with and without the control circuit of the present invention in terms of operating RPM and tank pressure vs. time.

Referring to FIG. 4, the typical start sequence RPM according to the prior art is indicated by the curve designated by the reference numeral 50. The governed engine RPM according to the present invention is shown by the curve designated by the reference numeral 51. The corresponding tank pressure for the prior art situation is shown by the curve designated by the reference numeral 52. The tank pressure according to the present invention is shown by the curve designated by the reference numeral 53.

As may now be appreciated by one skilled in the art, if the effective cranking speed of the engine is, for example, above 150 RPM, the effective time of start is increased from approximately 25 seconds to approximately 35 seconds representing a nearly 40 percent increase in the effective starting time.

What is claimed is:

1. A starter control system for an engine starter comprising:

means for sensing engine RPM;

means for determining engine off condition RPM;

means for determining a minimum cranking RPM;

means for determining a maximum cranking RPM;

means for determining an engine running RPM;

control means for establishing a desired engine cranking and starting sequence in response to the condition sensed sequenced response of the above listed means;

said means for sensing engine RPM further comprises a proximity sensor registering engine RPM in pulses; and said pulses are converted to a voltage proportional to RPM.

2. A starter control system for an engine starter according to claim 1, wherein said means for determining the determined listed RPM's comprise a voltage reference comparison.

3. A starter control system for an engine starter according to claim 1, wherein the desired engine starting sequence cannot be repeated until said engine off condition is first sensed.

* * * * *